US011228831B2

(12) United States Patent
Lam

(10) Patent No.: US 11,228,831 B2
(45) Date of Patent: Jan. 18, 2022

(54) RESONANCE SOUND GENERATION FLAT SPEAKER

(71) Applicant: DIGITAL OASIS LIMITED, Hong Kong (CN)

(72) Inventor: Yuk Lam, Hong Kong (CN)

(73) Assignee: DIGITAL OASIS LIMITED, Hong Kong (CN)

( * ) Notice: Subject to any disclaimer, the term of this patent is extended or adjusted under 35 U.S.C. 154(b) by 0 days.

(21) Appl. No.: 16/755,194

(22) PCT Filed: Oct. 5, 2018

(86) PCT No.: PCT/IB2018/057742

§ 371 (c)(1),
(2) Date: Apr. 10, 2020

(87) PCT Pub. No.: WO2019/073349

PCT Pub. Date: Apr. 18, 2019

(65) Prior Publication Data

US 2021/0029444 A1 Jan. 28, 2021

(30) Foreign Application Priority Data

Oct. 10, 2017 (HK) ..... 17110173.9
Apr. 17, 2018 (HK) ..... 18104976.0

(51) Int. Cl.
*H04R 1/28* (2006.01)

(52) U.S. Cl.
CPC ..... *H04R 1/2811* (2013.01)

(58) Field of Classification Search
CPC ..... H04R 1/023; H04R 1/028; H04R 1/2811; H04R 7/04; H04R 7/045; H04R 7/06; H04R 7/10; H04R 17/10; H04R 2201/021; H04R 2440/00; H04R 2440/01; H04R 2440/05; H04R 2440/07
See application file for complete search history.

(56) References Cited

U.S. PATENT DOCUMENTS 9,584,891 B1 2/2017 Blaszczak et al.
2002/0176597 A1* 11/2002 Petroff ..... H04R 7/04 381/430
2013/0259270 A1* 10/2013 Zhou ..... H04R 1/028 381/150

FOREIGN PATENT DOCUMENTS

CN 104333833 A 2/2015
CN 104756515 A 7/2015
CN 105264909 A 1/2016
(Continued)

*Primary Examiner* — Mark Fischer
(74) *Attorney, Agent, or Firm* — Muncy, Geissler, Olds and Lowe, P.C.

(57) ABSTRACT

A resonance flat panel speaker includes a wireless music vibration body, at least one resonance sounding board and a resonance sounding cloth arranged in the wireless music vibration body. A first surface of the resonance sounding board is attached to a sound vibrator in the wireless music vibration body. A second surface of the resonance sounding board is attached to an inner surface of the resonance sounding cloth. The resonance sounding cloth is combined with an outer frame of the wireless music vibration body with a tensile force of 5 kg-20 kg. The resonance sounding board is matched with different audio resonance points of the resonance sounding cloth to produce a full range flat panel speaker.

10 Claims, 2 Drawing Sheets

(56) References Cited

FOREIGN PATENT DOCUMENTS

| | | | |
|---|---|---|---|
| CN | 107205556 | A | 9/2017 |
| HK | 1247526 | A2 | 9/2018 |

* cited by examiner

RESONANCE SOUND GENERATION FLAT SPEAKER

FIELD OF THE INVENTION

The invention relates to a speaker, in particular to a resonance flat panel speaker.

BACKGROUND OF THE INVENTION

The sound principle of traditional speaker is to generate sound by touching the diaphragm through generation of electrical signals, the basic principle comes from Fleming's left-hand law, put a current-carrying wire perpendicular to the magnetic line between the south and north poles of the magnet, the wire will be moved by the interaction between magnetic line and current, then if a diaphragm is attached to this wire, the diaphragm will generate forward and backward movement along with the change of current. When related diaphragms move and vibrate, it makes surrounding air vibrate, thus the speaker generates sound. However, the size of speaker is generally big, especially the big thickness normally occupies large area, heavy and unaesthetic appearance will bring great limitation in placing it. For the limited living space in today's environment, it is not so appropriate.

In recent years, there are some speakers using the principle of object vibration, make the vibration sounding device fasten on the surface of fixing object (e.g. surface of wooden table, glass and etc.), utilize the vibration of related fixing object to generate sound. Even though the size of speaker can be smaller in this case, the sound frequency will change according to property of related objects, and its application will be limited.

DEFECTS OF PRIOR ART

1. The speakers on current market are generally big, especially the big thicknesses normally occupy large areas, heavy and unaesthetic appearance will bring great limitation in placing them. For today's living space where requires simplicity and individuality, they are not so appropriate.
2. The speakers which driven by sound vibrator can only generate very small range of frequencies by itself. Although the frequency range can be changed through attaching to other object surface, but this change will depend on property of object, different objects provide different sound effects; the harder the material is, the higher the resonance frequency will be, which make the market is limited.

SUMMARY OF THE INVENTION

The main purpose of this invention is to provide a resonance flat panel speaker for solving the technical problems of current speakers including the generally big size, especially big thickness normally occupies large area, heavy appearance and range of application is limited.

In order to realize above purpose, the invention provides a resonance flat panel speaker which comprises wireless music vibration body, at least one resonance sounding board and one piece of resonance sounding cloth arranged in said wireless music vibration body; the first surface of said resonance sounding board is attached to the sound vibrator in said wireless music vibration body, the second surface of said resonance sounding board is attached to the inner surface of said resonance sounding cloth; said resonance sounding cloth is combined with the outer frame of said wireless music vibration body with the tensile force of 5 kg-20 kg.

Optionally, quantity of said resonance sounding boards is two, the first surface of each said resonance sounding board is individually attached to at least one said sound vibrator.

Optionally, material of said resonance sounding board is honeycomb paper.

Optionally, material of said resonance sounding cloth is nylon.

Optionally, the distance between said sound vibrator and said frame is at least 20 mm.

Optionally, said wireless music vibration body also comprises a back plate, said back plate is installed on said frame, said back plate has hanging hook or anti-vibration pad.

Optionally, the wireless music module in said wireless music vibration body which can send music source to said sound vibrator connects with charging battery.

Optionally, control button and charge interface on said wireless music vibration body all connect with said wireless music module, and set at the edge of the frame.

Optionally, said tensile force is 10 kg.

Optionally, the range of length and width of said resonance sounding board is 80 mm-250 mm.

Advantageous result of the invention: the invention can utilizes sound vibrator (sound exciter) to generate sound, through the resonance vibration of resonance sounding board, then push resonance sounding cloth, using the density, elasticity, resonance point of cloth, and the stretching force, tensile force with outer frame to work as resonance sounding cloth; said resonance sounding board uses light and hard material (honeycomb paper), very obvious resonant sound can be generated for the frequencies over 180 Hz (high-mid), and the resonance is not obvious for the frequencies 180 Hz or below (low); said resonance sounding cloth is soft material, thus very obvious resonant sound can be generated for the frequencies under 180 Hz (low), but the resonance is not obvious for the frequencies 180 Hz or above (high-mid); allow the complete flat board to be a sounding device, output the sound equally.

Use different sizes outer frames of flat board to match with different sizes resonance sounding board and sound vibrator (sound exciter) in appropriate proportion, then generate sound through resonance vibration made by resonance sounding board, to ensure the output tone quality and power. The thickness of related speaker can be reduced, but the tone will not be affected.

Different personalized art patterns can be printed on the surface of resonance sounding cloth, its ornamental value will be higher.

DESCRIPTION OF THE COMPONENTS

1—wireless music vibration body 11—sound vibrator 12—frame 13—back plate 131—hanging hook 14—control button 15—charging battery 16—wireless music module 2—resonance sounding cloth 3—resonance sounding board 31—honeycomb cavity 32—cover plate Implementation, function and advantage of the invention will be further described combining with embodiments and according to drawings.

DETAILED DESCRIPTION OF THE INVENTION

Below further describe the invention combining with drawings and embodiments. The embodiments describe herein are only used for explaining the invention, but not to limit the invention.

Figure 1:
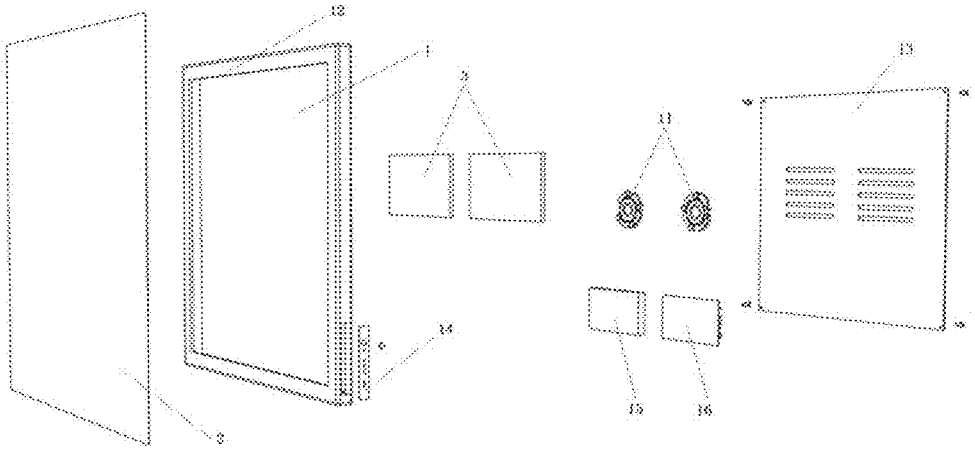
FIG. 1 is the exploded view of the invention.

Embodiment 1 is shown as FIG. 1, the invention comprises wireless music vibration body, at least a resonance sounding board (3) and a piece of resonance sounding cloth (2) arranged in said wireless music vibration body; the first surface of said resonance sounding board (3) is attached to the sound vibrator (11) in said wireless music vibration body (1), the second surface of said resonance sounding board is attached to the inner surface of said resonance sounding cloth; said resonance sounding cloth is combined with the outer frame of said wireless music vibration body with the tensile force of 5 kg-20 kg.

The invention uses wireless signal transmission technology, and preferably use Bluetooth wireless transmission technology to transfer music source from player device to wireless music module (16) of the invention, then said wireless music module (16) will convert the wireless signal to audio frequency, use the integration of resonance sounding board (3) and resonance sounding cloth (2) of the invention to play the sound.

Sound vibrator (11), resonance sounding board (3) and resonance sounding cloth (2) constitute a replaceable resonance sounding component, when sound vibrator (11) makes the sound output into frequency vibration, this vibration leads said resonance sounding board (3) and said resonance sounding cloth (2) to vibrate at the same time which turn into a resonance sounding system. Said resonance sounding cloth (2) is combined with said outer frame (12) with the tensile force of 5 kg-20 kg, some strength is needed to combine said resonance sounding cloth (2) with said frame (12).

Nevertheless, too much strength will shorten the lifetime of said resonance sounding cloth (2), too little will affect the resonance effect of said resonance sounding cloth (2).

Preferably, said tensile force is 10 kg. After many tests, 10 kg tensile force is the most appropriate when using the resonance sounding board 80 mm×80 mm.

For different frequencies, the material ingredient and hardness of said resonance sounding board (3) and said resonance sounding cloth (2) will have different resonance effects, the general music is in the frequencies between 20 KHz (high) and 80 KHz (low), the frequencies 180 Hz or below (low) will not generate obvious resonance. Instead, said resonance sounding cloth (2) is soft material, it can generate very obvious resonance sound for the frequencies under 180 Hz (low), but for the frequencies 180 Hz or above (high-mid), there will not be obvious resonance.

Put two resonance components with different materials together to constitute a part of complete resonance sounding component, it uses the advantage of two different materials, and let them complement each other, in order to resonate the music with full range (high-mid, low) effect.

Embodiment 2, base on above embodiment, the invention provides a resonance flat panel speaker, the difference between this embodiment and above embodiment is: preferably, quantity of said resonance sounding boards (3) is two, the first surface of each said resonance sounding board (3) is individually attached to at least one said sound vibrator. The sound sources of 2 sets of said resonance sounding boards (3) and said sound vibrator (11) (sound exciter) are respectively attached to inner surface of resonance sounding cloth (2), thus improve the 3D sound effect in a limited range. Of course, the quantity of resonance sounding boards can be more than two.

Embodiment 3, base on above embodiments, the invention provides a resonance flat panel speaker, the difference between this embodiment and above embodiments is: material of said resonance sounding board (3) is honeycomb paper. The hardness and lightness of honeycomb paper meet the requirement, in comparison with other board structures, the honeycomb interlayer has the largest intensity/mass ratio, its structure is similar to isotropy, has good stability that will not deform easily, has outstanding anti-pressure ability and anti-bending ability; the material of said resonance sounding cloth (2) is nylon, also can be fabric, nylon and fabric are soft which meet the condition of resonance sounding.

Embodiment 4, base on above embodiments, the invention provides a resonance flat panel speaker, the difference between this embodiment and above embodiments is: the distance between said sound vibrator (11) and said frame (12) is at least 20 mm, in order to be convenient for production and ensure the resonance sounding board (3) and resonance sounding cloth (2) can generate effect. When said frame (12) has different sizes, the size ratio of resonance sounding board (3) can be adjusted to ensure the output tone quality and power.

Figure 2:
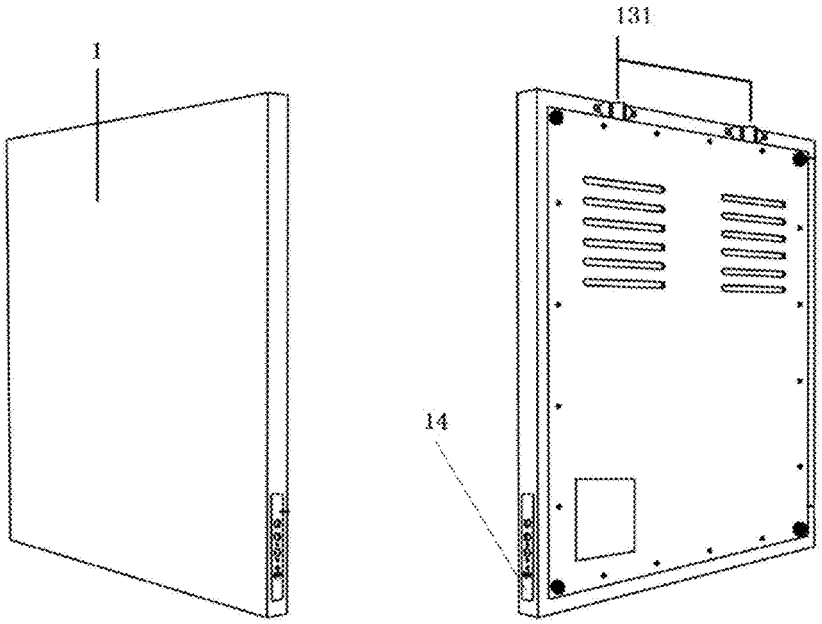
FIG. 2 is the structural diagram of the invention.

Embodiment 5, base on above embodiments, the invention provides a resonance flat panel speaker, the difference between this embodiment and above embodiments is: said wireless music vibration body also comprises a back plate, said back plate is used to protect each component in said wireless music vibration body (1); as shown in FIG. 2, said back plate (13) is installed on said frame (12), said back plate (13) has hanging hook (131) or anti-vibration pad, in order to install the flat panel speaker on the wall easily, significantly save the room space. Besides, different personalized art patterns can be printed on the surface of resonance sounding cloth (2) to make the ornamental value of this invention higher. The wireless music module (16) in said wireless music vibration body (1) which can send music source to said sound vibrator (11) connects with charging battery (15). The control button (14) and charge interface on said wireless music vibration body (1) all connect with said wireless music module (16), and set at the edge of the frame (12).

The range of length and width of said resonance sounding board can respectively be 80 mm-250 mm. The invention takes 250 mm length and 80 mm width as an example, it realizes a very good technical effect.

Figure 3:
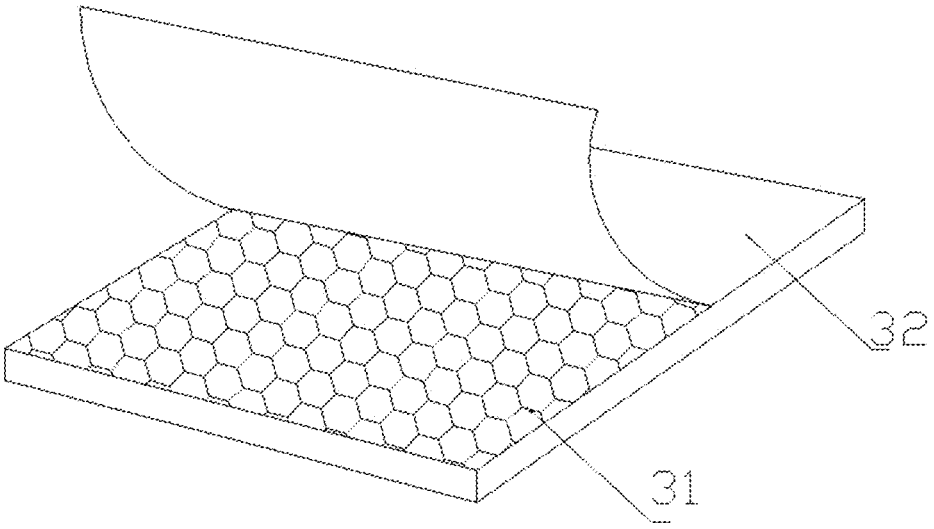
FIG. 3 is the structural diagram of the resonance sounding board of the invention.

Wherein, as shown in FIG. 3, the installation method of above said honeycomb paper and resonance sounding cloth is: the honeycomb cavity is set preferably perpendicular to said resonance sounding cloth, the material of said resonance sounding board may not be honeycomb paper, it can be honeycomb board with similar structure which made by other materials, two surfaces of this honeycomb paper are respectively covered by a thin cover plate (32), there are one by one honeycomb cavities (31) in the cover plate (32), the shape of these honeycomb cavities (31) may not be hexagon, they can be pentagon, quadrangle and etc, can also realize the purpose of resonance amplifying.

Preferably, thickness of said resonance sounding board is 2 mm, in this case, the tone and amplifying effect of said flat panel speaker are the best, and the flat panel speaker will not be obese.

The invention utilizes related sound vibrator sounding device, uses the vibration and resonance characteristics of different materials and match them together to produce the sounding device of flat panel speaker. Utilize the high-mid to high frequency range resonance point of hard material to make resonance sounding board (3), wherein the hard material of said resonance sounding board (3) needs to be light, in order to attach with other materials easily and effectively. Utilize the low frequency resonance point of soft material to make resonance sounding cloth (2), said resonance sounding cloth (2) needs to have appropriate stretching force and tensile force, in order to attach with said resonance sounding board (3) and provide effective sound. Different resonance points of said resonance sounding board (3) and said resonance sounding cloth (2) coordinate together to produce full range flat panel speaker. As the flat panel speaker uses flat structure resonance component, the structure of speaker is very compact, the size is relatively small which can significantly save the room space, and the costs of materials are cheap, it is easily widely promoting the use.

Above contents are further description of the invention combining with specific preferable embodiments, but cannot limit the embodiment of the invention to these only. For the common technicians who belong to the technical field of the invention, they can make some simple derivations or substitutions on the premise of not departing from the concept of the invention, it should be deemed as belonging to protection scope of the invention.

The invention claimed is:

1. A resonance flat panel speaker, comprising:

a wireless music vibration body;

a resonance sounding cloth; and at least one resonance sounding board arranged in said wireless music vibration body;

wherein a first surface of said at least one resonance sounding board is attached to a sound vibrator in said wireless music vibration body, wherein a second surface of said at least one resonance sounding board is attached to an inner surface of said resonance sounding cloth;

wherein said resonance sounding cloth is combined with an outer frame of said wireless music vibration body with a tensile force of 5 kg-20 kg.

2. The resonance flat panel speaker of claim 1, wherein, a quantity of said at least one resonance sounding boards is two, the first surface of each said at least one resonance sounding board is individually attached to said sound vibrator.

3. The resonance flat panel speaker of claim 1, wherein, a material of said at least one resonance sounding board is honeycomb paper.

4. The resonance flat panel speaker of claim 1, wherein, a material of said resonance sounding cloth is nylon.

5. The resonance flat panel speaker of claim 1, wherein, the distance between said sound vibrator and said outer frame is at least 20 mm.

6. The resonance flat panel speaker of claim 1, wherein, said wireless music vibration body also comprises a back plate, said back plate is installed on said outer frame, said back plate has a hanging hook or an anti-vibration pad.

7. The resonance flat panel speaker of claim 1, comprising a wireless music module on said wireless music vibration body which can send a music source to said sound vibrator, wherein the wireless music module connects with a charging battery.

8. The resonance flat panel speaker of claim 7, wherein, a control button and a charge interface on said wireless music vibration body all connect with said wireless music module, and set at an edge of the outer frame.

9. The resonance flat panel speaker of claim 1, wherein, said tensile force is 10 kg.

10. The resonance flat panel speaker of claim 1, wherein, a range of a length and a width of said at least one resonance sounding board is 80 mm-250 mm.

* * * * *